United States Patent [19]

Fromman

[11] 4,222,398

[45] Sep. 16, 1980

[54] ELECTRICALLY POWERED HAIR ROLLING DEVICE

[75] Inventor: Arthur R. A. Fromman, 4517 N. 17th Dr., Phoenix, Ariz. 85015

[73] Assignee: Dennis L. Taelman, Phoenix, Ariz.; part interest

[21] Appl. No.: 711,709

[22] Filed: Aug. 5, 1976

[51] Int. Cl.[2] ..... A45D 2/00

[52] U.S. Cl. ..... 132/34 R

[58] Field of Search ..... 132/34 R, 40, 42, 9; 128/35, 343, 317; 74/206

[56] References Cited

U.S. PATENT DOCUMENTS

| | | | |
|---|---|---|---|
| 2,448,263 | 8/1948 | Hannon | 132/34 R |
| 2,523,062 | 9/1950 | Rogers | 132/40 |
| 2,586,103 | 2/1952 | Smith | 132/34 R |
| 2,935,070 | 5/1960 | Auz | 132/34 R |
| 3,605,762 | 9/1971 | Fromman | 132/9 |

*Primary Examiner*—G. E. McNeill

*Attorney, Agent, or Firm*—Warren F. B. Lindsley

[57] ABSTRACT

An electrically powered device for curling hair including a power element containing handle housing portion and an angularly disposed, rotatable chucking device and spindle with a removable hair curler associated in driven relationship therewith. Make and break connections between the rotatable elements and the actuating means are made by the application of hand or finger pressure to the end of the curler, the end of the spindle or to conveniently located switches.

8 Claims, 10 Drawing Figures

FIG. 1
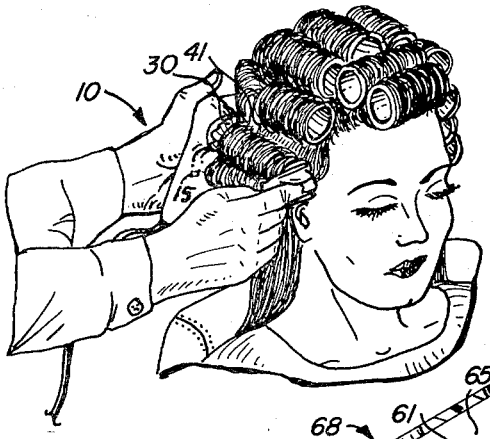
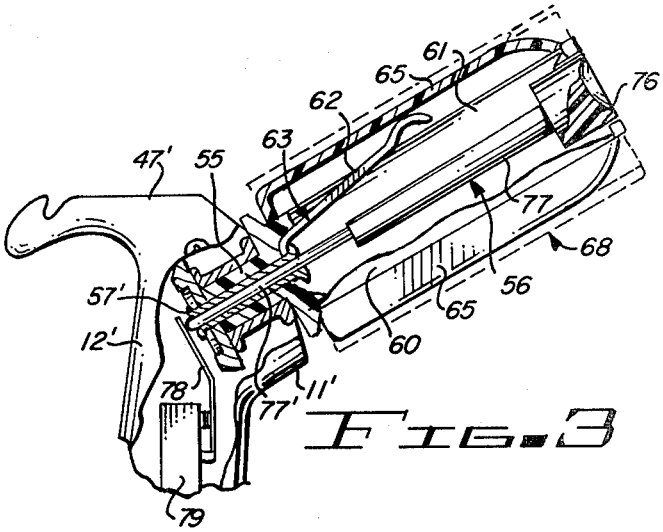
FIG. 3
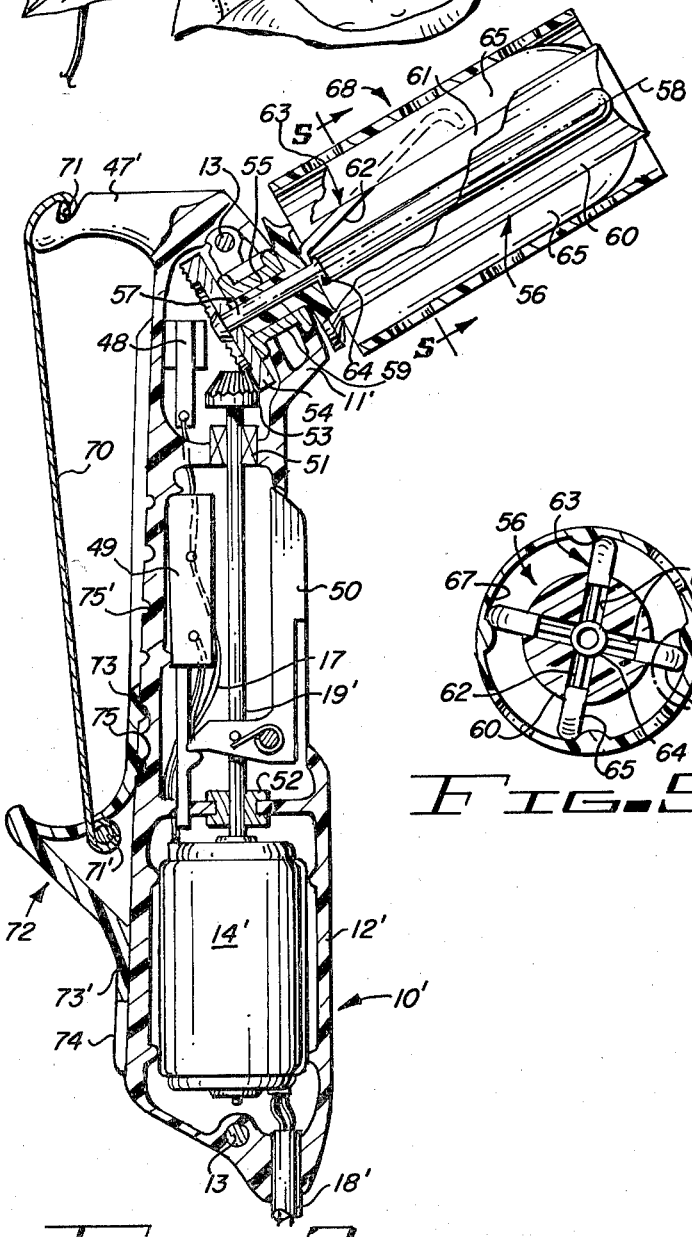
FIG. 2
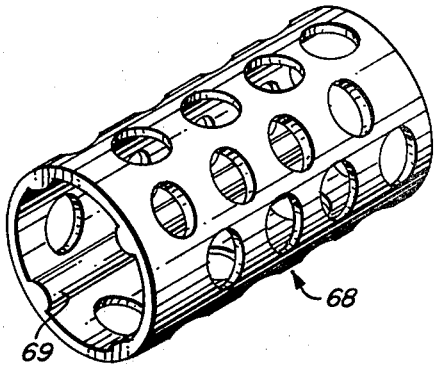
FIG. 4
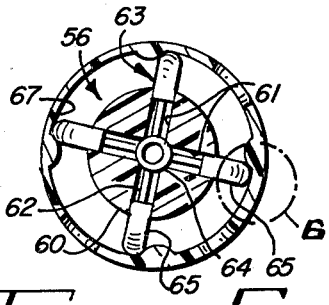
FIG. 5
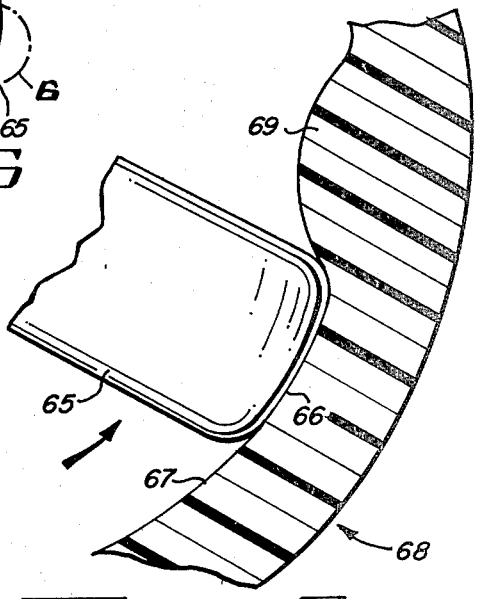
FIG. 6

ELECTRICALLY POWERED HAIR ROLLING DEVICE

BACKGROUND OF THE INVENTION

This invention relates to personal grooming devices and more particularly to devices for dressing hair to enhance the appearance and to characterize and individualize the coiffure of the user.

1. Field of the Invention

This invention is particularly directed to a device for curling or waving hair by imparting powered movement to a curler or the like to wind a tress or span of hair thereon and to eliminate the need for rotating curlers by hand or the rolling of the hair around the fingers.

2. Description of the Prior Art

It has been customary in grooming hair to roll a tress or a plurality of strands of hair on a curler and to apply a moistening agent to the hair. The hair is left in its rolled state until it has dried and set. After the hair has set, the curlers are removed leaving the hair in a curled or waved condition. In the dressing of hair an unskilled or a partially disabled person has difficulty in performing the rolling operation which affects the final appearance of the hair. Furthermore, a skilled operator experiences fatigue in winding the hair on the curlers particularly if hair dressing is practiced as a profession.

Although attempts have been made to electrically operate hair rollers, many of the devices have used friction drives between the electric motor of the roller and the spindle to eliminate the danger of pulling of the hair and causing injury. These have not been satisfactory since they have been difficult to operate and the friction coupling erratic in operation. However, since it is necessary to put tension on the hair to roll a tight curl, some other means of safe roller operation is necessary other than a friction drive coupler.

SUMMARY OF THE INVENTION

In accordance with the invention claimed, a new and improved self contained power driven hair rolling device of lightweight construction is provided which may be supported and easily manipulated in one hand of the user in a manner permitting free use of the fingers of both hands for attaching strands of hair to a removable curler. The device disclosed provides novel means for making and breaking the connection of a power transmission with an electric motor and a rotatable spindle to selectively rotate a hair curler in either direction at a desired speed at the user's option.

It is therefore one object of this invention to provide an improved lightweight, self-contained, power driven hair rolling device.

Another object of this invention is to provide an improved device for selectively rotating a hair roller or curler in either direction.

A further object of this invention is to provide an improved hair rolling device which employs a novel drive train or transmission between an electric motor and a hair curler which may be supported by one hand and controlled by some of the fingers of that hand leaving the other fingers of both hands free to arrange the hair.

A still further object of this invention is to provide an improved power driven hair rolling device which includes an exposed rotatable spindle and chucking device with which a hair curler may be associated in driven relation and rotated when the same is continuously actuated by the application of hand or finger pressure by the operator.

A still further object of this invention is to provide an improved power driven hair rolling device having means for controlling the degree of torque and tension applied to the hair to obtain a tight curl yet prevent possible injurious pulling of the hair.

A still further object of this invention is to provide an improved power driven hair rolling device having adjustable means associated with the handle housing of the device for assisting the user in the holding and manipulation of the device during the curling operation.

Further objects and advantages of the invention will become apparent as the following description proceeds and the features of novelty which characterize this invention will be pointed out with particularity in the claims annexed to and forming part of this specification.

BRIEF DESCRIPTION OF THE DRAWINGS

In order to clarify the relationship of the various figures of the drawings, it should be noted that the drawings disclose separate versions of the electrically powered hair rolling device of this invention. One version with its options and modifications illustrated in FIGS. 1, 7, 8, 9 and 10 is a "professional" version designed primarily for use in beauty salons by skilled operators to which speed and the quality of the operation is essential. The other version with its options and modifications illustrated in FIGS. 2, 3, 4, 5 and 6 is a "personal" version that is designed primarily for use by the average unskilled person to which safety, simplicity and ease of operation are the most important factors.

Therefore, the present invention may be more readily described by reference to the accompanying drawings in which:

FIG. 1 is a perspective view of an operator using the "professional" version of the device which embodies the features of the invention in the hair rolling operation.

FIG. 2 is a vertical sectional view with some parts in elevation and broken away showing the complete assembled "personal" version of the invention in readiness for performing the hair rolling operation.

FIG. 3 is a fragmentary side elevational view partly in section and broken away illustrating a modified form of the head and spindle portion of the device shown in FIG. 2.

FIG. 4 is a perspective view of a slightly modified form of a conventional curler that is used in conjunction with the device shown in FIG. 2.

FIG. 5 is a transverse sectional view taken on the line 5—5 of FIG. 2 illustrating one method of mounting a curler on the exposed drive spindle of the device.

FIG. 6 is a greatly enlarged fragmentary sectional view showing the driving relation between the blades of the spindle and the wall or base of the curler.

DESCRIPTION OF THE PREFERRED EMBODIMENTS

Figure 7:
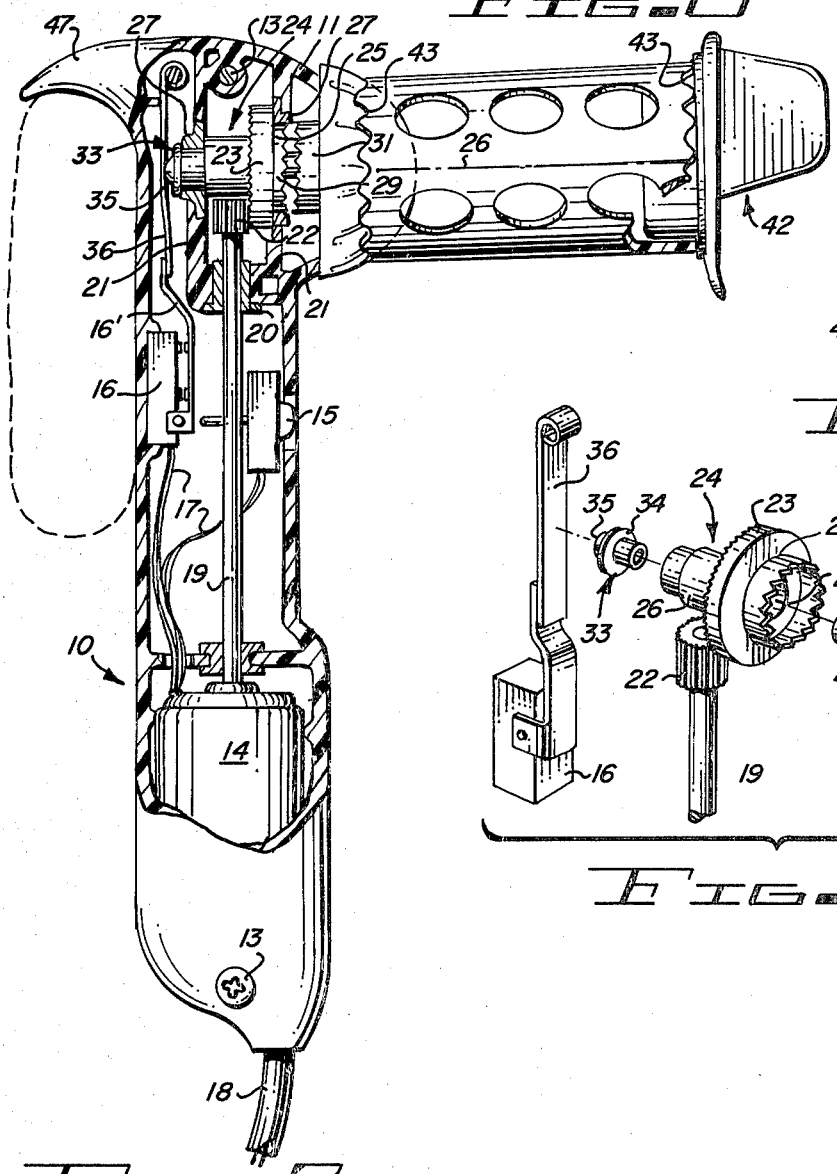
FIG. 7 is a side elevational view partly in section and broken away showing the complete assembled "professional" version of the device in readiness for performing the hair rolling operation.

Referring more particularly to the drawings for a more detailed description of the construction and other features of the invention by character of reference, FIG. 1 discloses the relative position of an operator when using the hair rolling device shown in FIG. 7 on the head of a client. FIGS. 7 and 2 illustrate assembled versions of two different hair rolling devices each including a "grip type" handle housing 10 and 10', respectively.

The handle housings 10 and 10' can be identical in shape and size except for the angularity of their outwardly projecting head portions 11 and 11' which are integral with their handle portions 12 and 12', and other optional features which will further be described.

The handle housings 10 and 10' are preferably fabricated of lightweight, high tensile strength plastic material in two substantially hollow mating halves. When assembled together by means of suitable screws 13 these mating halves are adapted to enclose most of the electrical and mechanical components of the device in shock-proof and dust-proof relationship therein.

The "professional" version of the hair rolling device of this invention shown in FIGS. 7–10 of the drawings includes in addition to its slightly modified handle housing portion 10 from which the projecting head portion 11 extends outwardly at a 90 degree angle therefrom, an electrically powered actuating system which consists of a single speed, reversible motor 14, a momentary on switch 15, a polarity reversing switch 16, suitable wiring 17 connecting said switches to the motor in operating relationship, and a power-cord 18 for connecting the motor to an electric power supply source, such as an electrical outlet wall plug (not shown).

The mechanical components of the "professional" version of the device shown in FIGS. 1 and 7 are completely enclosed in handle housing 10 and include a vertically extending motor shaft 19 centrally mounted in a suitable bearing 20 supported by transverse webs 21 formed in the upper portion of the handle housing. The motor shaft 19 is provided at its extreme upper end with a drive gear 22 adopted to be retained in constant mesh with a driven gear 23 formed on the inner side of a driven clutch member 24. The outer side of driven clutch member 24 is provided with an integral cylindrical projection 25 having teeth formed on its outer rim.

Clutch member 24 is journaled to rotate freely about its horizontal axis 26 in suitable aligned bearings 27 fixed in the depending transverse webs 21 of the handle housing 10. The clutch member 24 is provided with a central bore 28 which is sized to receive the longitudinally extending shaft 29 of a drive cone clutch assembly 30 in free rotatable sliding relationship to thus position the toothed rim of the inwardly projecting integral extension 31 of the drive cone clutch in horizontal alignment with the teeth on the rim of the extension 25 of the driven clutch member 24.

The inner end of shaft 29 of the drive cone clutch assembly 30 is provided with a counter bore 32 which is sized to receive the inwardly projecting stem portion of a thrust bearing 33. This bearing is provided with a circular flange abutment 34 that normally bears against the face of the bearing 27 mounted in the inner transverse web 21. The outer face of flange abutment 34 is provided with a rounded end projection 35 that remains in contact with the flat surface of an inwardly biased depending spring member 36 which is rigidly secured at its upper end to a transversely extending pin forming an integral part of handle housing 10.

The outer end of shaft 29 and its integral clutch extension 31 projects outwardly beyond the head portion 11 of handle housing 10. A cone drive head member 37 is demountably attached in fixed relationship thereto by means of a suitable screw 38. The cone drive head 37 is preferably hemispherical in form having a partly hollowed out interior surface and a plurality of equally spaced radial ribs or convolutions 39 that form a scalloped edge surface 40 on its outer perimeter the purpose of which will become evident as this description proceeds.

Used in conjunction with the "professional" version of the hair rolling device described in the preceding paragraphs is a slightly modified form of a conventional curler 41 and either of two forms of curling guides 42 and 42', respectively all of which accessories and their application is clearly indicated and shown in FIGS. 1, 7, 8, 9 and 10 of the drawings.

Curler 41 is conventional in most respects, being of a cylindrical shape and having the usual plurality of through holes in its cylindrical wall. It may be provided with a plurality of small pointed projections (not shown) on the outside and inside of said wall to assist in separating and holding the strands of hair wrapped thereon. The size of the curler may vary somewhat in length and diameter to provide more versatile usage as long as the configuration of one or both of their scalloped end or ends 43 is designed to mate in driven relationship with the ribs or convolutions 39 provided on the exposed cone drive head 37 of the clutch assembly 30 in the plane of contact with each other.

Figure 8:
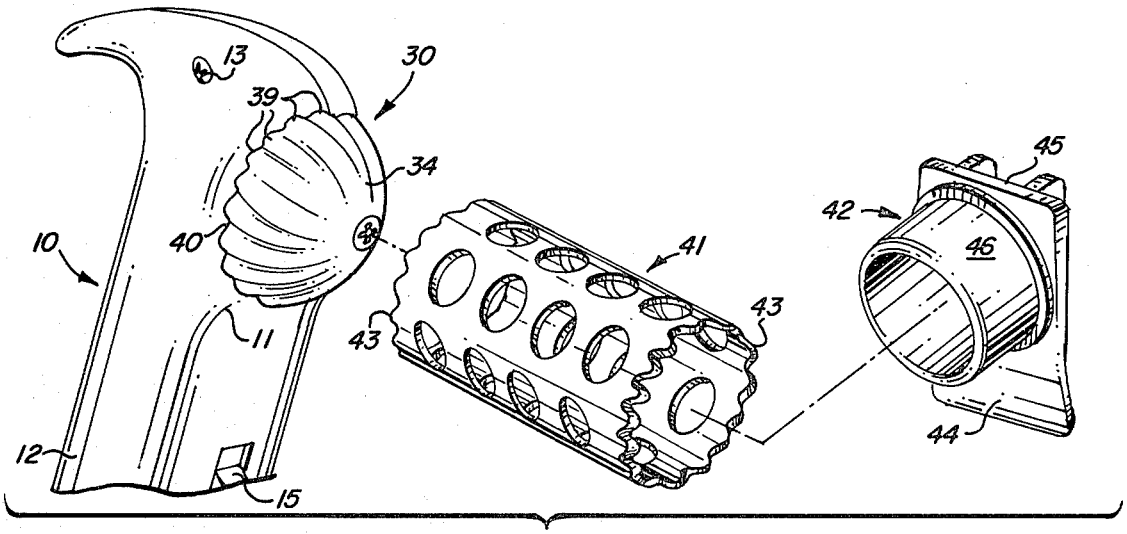
FIG. 8 is an exploded perspective view showing the exposed cone driving head portion of the device of FIG. 7 in its relation to an unconventional type curler and a curling guide before their subsequent association with the cone drive.
Figure 10:
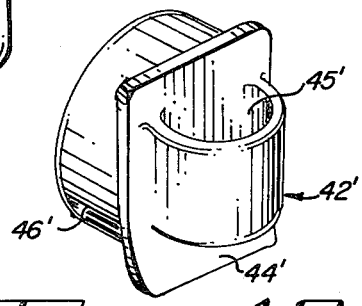
FIG. 10 is a perspective view of a modified form of the curling guide shown in FIGS. 7 and 8 of the drawings.
Figure 9:
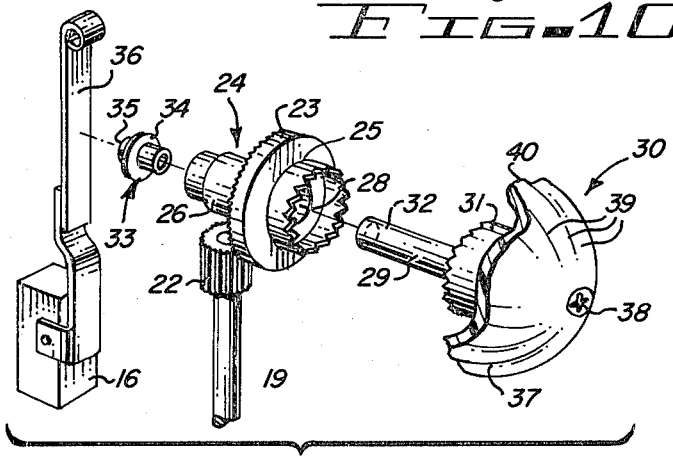
FIG. 9 is an exploded perspective view showing the electrical and mechanical make and break elements of the cone drive in their respective relation to each other.

The preferred version of a curling guide such as indicated by the reference character 42 and shown in FIGS. 7 and 8 used in conjunction with the curler 41 and the modified version 42' of the same shown in FIG. 10 are similar in their design and usage and are fabricated as single units of lightweight plastic. Both forms include flat surfaced elongated pressure plate portions 44 and 44', respectively, that are slightly curved outwardly at their lowermost ends, and outwardly extending finger nest or loop portions 45 and 45', respectively. Cylindrically shaped hollow curling guide portions 46 and 46' are formed integral with the pressure plates and extend outwardly from opposite faces of the same. The curling guides 42 and 42' can be held by the user's fingers holding the finger nest 45 between them or one finger extending through the finger loop 45' in a manner most comfortable to the user.

The outside diameter of the cylindrical guide portion 46 of the curling guide member 42 is sized to fit with slight clearance in the inside diameter of curler 41 and to extend a short distance therein when a surface of pressure plate 44 is in light contact with the vertexes of the scallops 43 formed on one end of curler 41. The function and relative association of the curling guides 42 and 42' with the curler 41 will be explained.

It should be noted and understood that although the drawings show and the description indicates that the scallops 43 are provided on both ends of curler 41 mainly for the convenience of the operator in quickly selecting and positioning a curler with one of its scalloped ends in the proper relation to the cone drive head 37 of the device, it may be desirable to provide one end only of the curler with such scallops thus providing an inexpensive curler which would function equally well with curling guides 42 and 42'.

Another difference between the curling guides 42 and 42' is that the hollow cylindrical shaped guide portion 46' of guide 42' is designed and sized to fit with slight clearance over the outside diameter of curler 41, thus being capable of performing its function and providing a choice for the operator who may choose to utilize either one.

It should be noted that the grip type handle housings 10 and 10' utilized in both versions of this invention are provided with hook like projections 47 and 47' at their top ends the use of which will further be explained. It also should be noted that like or similar component parts of both versions are indicated on the drawings by the same reference characters with prime or double prime denotations to thus clarify their specific relationship to that version.

The "professional" version of the electric powered hair rolling device of this invention described in the preceding paragraphs and shown in FIGS. 7 and 8 of the drawings is intended for use by skilled operators.

With power cord 18 plugged into a convenient electric supply source, the operator holds the device in one hand with his fingers and thumb lightly surrounding the handle portion of housing 10 so that the hook like projection 47 rests in the crook of his hand, thus providing substantially finger free support for the device while positioning and manipulating the same for the hair rolling operation.

The operator then selects one of the curling guides 42 or 42' placing one finger of his free hand in its finger nest 45 or finger loop 45'. The operator then places the same in or on the end of curler 41 with the curler with its associated guide positioned in juxtapositioned relationship to that portion of the patron's hair to be rolled. After attaching a tress or several strands of hair to the curler and placing extension 31 of the exposed head 37 of the drive cone clutch 30 in the bore of the curler at its open end so that its ribs or convolutions 39 are in mating contact with the scalloped end 43 of the curler, finger and hand pressure is applied to the plate portion 44 of the curling guide member. This action causes the inner face of the same to come into contact with the vertexes of scallops 43. Continued finger and hand pressure on curling guide 42 forces the curler and the drive cone clutch assembly 30 to which it is now connected in driving relationship to move longitudinally toward the handle housing 10 of the device. This movement causes the teeth on the cylindrical extension 31 of the drive cone assembly to come into mating contact with the teeth on the cylindrical extension 25 of the driven clutch member 24 to place curler 41 in driven relationship ready for use in performing the hair rolling operation.

At the same time that the above described action is taking place, the integral projecting shaft 29 of the drive cone clutch 30 is moving forwardly and longitudinally in the central bore 28 of the driven clutch member 24, causing its end to come into contact with the inner face of the circular flange 34 on the thrust bearing 33. This causes the rounded end projection 35 of the same to move the inwardly biased spring member 36 outwardly into contact with the upper end of spring member 16'. This action provides a means for opening or closing the contacts of the polarity reversing switch 16, thus activating the electric motor 14 which, through its electrical and mechanical connections, is capable of rotating curler 41 in either direction. The stopping and reversing action is dependent only on the finger and hand pressure control applied by the operator.

It should be noted that the momentary on switch 15 is an optional feature that may be utilized to activate the electric motor and hence rotate curler 41 in either direction when used in association with the polarity reversing switch 16.

The "personal" version of the electrically powered hair rolling device of this invention is shown in FIGS. 2 and 3 of the drawings. It is similar in general design and operation as the described "professional" version utilizing many of the same or similar components to perform the hair rolling function in a simple, satisfactory manner.

This version of the device includes a modified grip type handle housing 10' having an angular projecting head portion 11', a handle portion 12' and a hook like projection 47' for holding and supporting the device while in use. It also includes a variable speed motor 14', power cord 18', a pair of button type switches that are located on each side of the handle housing near its top end convenient to the user's fingers, and a combined switch rheostat 49 having a slide bar adjusting means that is controlled by a spring biased push button lever 50. All of the electrical control elements are connected in operative relationship to the motor by suitable wiring 17' that is enclosed in the hollow interior of handle housing 10'.

The mechanical components of this version of the device include a motor shaft 19' which is journaled in suitable upper and lower bearings 51 and 52 supported in transverse webs formed in the handle portion 12' of housing 10'. A bevel pinion drive gear 53 secured to the top of motor shaft 19' is adapted to be in constant mesh with a bevel driven gear 54 to provide a direct drive between the motor shaft and hub 55 of a spindle 56 to which it is secured in driving relation by a rivet 57. The rivet passes through the aligned central apertures on the angular axis 58 of the spindle. Hub 55 of the spindle is supported in rotative relationship in a suitable bearing 59 fixed in the angular head portion 11' of handle housing 10', as shown in FIG. 2.

Spindle 56 includes the hub portion 55 and an integral outwardly projecting cylindrical portion 60 which is provided with four equally spaced radial slots 61 that extend longitudinally thereof substantially to its concave end. The radial slots 61 are adapted to contain the narrow flat, radially and angularly disposed spring arms 62 of a spider 63, the hub 64 of which is anchored under the head of rivet 57 so that spring arms 62 are free to move radially outward in radial slots 61 of the cylindrical portion 60 of spindle 56.

Longitudinally extending channel shaped blades 65 that are curved radially inwardly at their outer ends and provided with diametrical smooth top surfaces 66 are positioned over the cam like curved end surfaces of spring arms 62 of spider 63. These blades are urged radially outward in slots 61 by light pressure exerted on their inner top surfaces by the cam like end surfaces of spring arms 62.

The diametrical top surfaces 66 of channel shaped blades 65 are adapted to fit and lightly contact the inside diameter surface or bore 67 of curlers 68. These curlers 68 are preferably made of plastic and are provided with the usual plurality of holes in their outside circumferential surface which may vary somewhat in diameter as long as their inside diameter or bore is greater than the cylindrical portion 60 of spindle 56 so that they may be readily slid over the radially extended blades 65 of the spindle.

The inside diameters or bores of curlers 68 are provided with radially spaced smooth contoured projections 69 that extend longitudinally the full length of the curlers. The concave edges of projections 69 are adapted to be engaged by the rounded edges of blades 65 in driving relationship therewith as shown in FIGS. 5 and 6.

Handle portion 12' of housing 10' is similar in most respects to the same component of the "professional" version previously described except for its angled relationship to axis 58 of its head portion 11' and driving spindle 56. This particular relationship together with the provision of an adjustable elastic strap 70 (shown in FIG. 2) provides an improved means for holding and supporting the device during a hair rolling operation.

Elastic strap 70 is removably secured at its top end by a cross pin 71 positioned in a transverse notch formed in the top surface of the hooklike projection 47' of the handle. At its bottom end it is removably secured by a cross pin 71' in a transverse slot formed in the concave wall of an outwardly projecting tang member 72. This tang member is provided with longitudinally extending flat foot portions 73 and 73', respectively, that are secured in sliding relationship betwen an opposed pair of longitudinally extending guide members 74. These guide members are formed as an integral part of handle portion 12' on the back surface thereof. The inner face of the upper foot portion 73 of the tang is provided with several transversely spaced projections 75 that are adapted to lodge in spaced transverse depressions 75' formed in the back surface of the handle portion 12' to provide a means for adjusting the tension of the elastic strap 70.

In order to use the "personal" version of the hair rolling device, the user grasps handle portion 12' in one hand with the crook of that hand contacting the concave underside portion of the hook-like projection 47'. The back of the user's hand contacts the inside surface of elastic strap 70 to thus hold and support the device in readiness for use in performing the hair rolling operation. This allows freedom of his fingers and thumb for manipulating the various switches of the device and assist with the hair rolling operation.

The user then places one of the curlers 68 on spindle 56 of the device by depressing the spring biased blades 65 of the spindle with the inside diametrical walls or bore of the curler. In this position, the blades are capable of exerting sufficient pressure against the sides of the longitudinal projections 69 in the curler to rotate the same with spindle 56 in either direction as determined by the user.

With the curler in place on the spindle, the user lifts the device, letting it virtually hang in the crook of one of his hands with the elastic strap 70 assisting on its support so that the angular relationship of the spindle and the attached curler is in substantially horizontal relationship to that portion of the tress of hair to be rolled. With the free fingers of that hand and all the fingers of the other hand, he or she then proceeds to attach a tress or plurality of strands of hair to the curler. Through activation of the electric motor 14' and its associated mechanical components by simply depressing one of the convenient switches 48 winding of hair on the curler occurs.

It should be noted that if the speed of rotation of the roller should be too fast or too slow to obtain the desired tightness of the curl being formed on the curler, this condition may easily be rectified by utilizing the spring biased push button lever 50 for regulating the speed of the motor through the interconnected rheostat 49. It should also be noted that if the hair was being rolled too tightly on the curler, consequently causing severe pulling of the hair and possible injury to the scalp, the driving torque transferred to the curler by means of the contact of the spring biased spindle blades 65 with the side edges of the lobes or projections 69 in the bore of the curler would quickly be diminished and the blades would ride over the same in a free-wheeling manner to thus prevent further rotation of the curler.

FIG. 3 which is a fragmentary view of the head and spindle portion of the device shown in FIG. 2 shows a modified form of a switching means for activating the rotation of the spindle 56 and the attached curler. Such means consists of a spring biased push button 76 having a concave end surface and an integral step down diameter shaft 77. This shaft extends inwardly through a central bore in the cylindrical portion 60 of the spindle 56 with its small diameter end 77' extending through a central bore in the rivet 57' that holds the hub of the spindle and the driven gear together in rotatable relationship. The rounded end of said shaft is adapted to contact the spring arm 78 of a make and break switch 79 that is suitably positioned in the handle portion 12' of the housing. Finger pressure on the concave end of the push button 76 is adapted to apply pressure to the spring arm 78 to close the contacts of switch 79. The release of finger pressure on push button 76 will cause the contacts of the switch to be opened and push button 76 to be returned to its normal position in the end of the cylindrical portion 60 of the spindle.

Although but a few embodiments of the invention have been shown and described, it will be apparent to those skilled in the art that various changes and modifications may be made therein without departing from the spirit of the invention or from the scope of the appended claims.

What is claimed is:

1. A device for rolling hair on a curler comprising:
an elongated type handle grip housing,
a motor mounted in one end of said housing,
a chucking device rotatably mounted on said other end of said housing to extend laterally therefrom and connected to said motor for rotation thereof,
a hook like projection extending laterally of said housing at a point diagonally from said chucking device on the same end of said housing,
said projection serving as a stop or catch by which the device can hang on the edge of the user's hand, thereby freeing the fingers of that hand for other uses,
a hollow curler adapted to be telescopically mounted over said chucking device for rotation therewith,
means for detachably connecting said curler to said chucking device, and
switch means on said housing for selectively energizing said motor.

2. The device set forth in claim 1 in further combination with:

a spring means arranged between said chucking device and said curler for biasing said curler out of engagement with said chucking device, and a free rotating pressure disk fittedly mounted within the free end of said curler and adapted to bias said spring means causing engagement of said curler with said chucking device and rotation of said curler, whereby release of pressure on said disk causes said spring means to disengage said curler from said chucking device.

3. The device set forth in claim 1 wherein:

said chucking device is provided with a hollow configuration at its free end which is surrounded by gear teeth and said curler is provided with a mating projection which is surrounded with gear teeth which cooperatively engage with the gear teeth on said chucking device.

4. The device set forth in claim 1 wherein:

said pressure disk is mounted in the end of said curler for relative rotation of said disk and said curler.

5. The device set forth in claim 1 wherein:

said chucking device extends substantially perpendicular from said housing.

6. A device for rolling hair on a curler comprising:

a housing, an electric motor carried in said housing, a chucking device rotatably connected to said motor and projecting laterally outward of said housing, a hollow curler adapted to be telescopically mounted over said chucking device for rotation therewith, said chucking device having a plurality of spacedly arranged ribs positioned along its outer periphery longitudinally of its length, said curler having a plurality of ridges along its hollow interior having a predetermined configuration so that the ridges frictionally engage said ribs to rotate therewith but slipping over said ribs upon a predetermined counter acting torque generated by the rolled hair of a user.

7. The device set forth in claim 6 wherein:

said ridges having an arcuate peripheral configuration.

8. The device set forth in claim 7 wherein:

said ribs extend along substantially the full length of said chucking device, and said ridges extend along substantially the full length of said curler.

* * * * *